US005328625A

United States Patent [19]

Farng et al.

[11] Patent Number: 5,328,625

[45] Date of Patent: Jul. 12, 1994

[54] LUBRICANT COMPOSITIONS COMPRISING TRIAZOLE-DERIVED ACID-ESTERS OR ESTER-AMIDE-AMINE SALTS AS ANTIWEAR ADDITIVES

[75] Inventors: Liehpao O. Farng, Lawrenceville; Andrew G. Horodysky, Cherry Hill; Ronald J. Poole; John R. Donofrio, both of Mullica Hill, all of N.J.

[73] Assignee: Mobil Oil Corporation, Fairfax, Va.

[21] Appl. No.: 986,655

[22] Filed: Dec. 8, 1992

[51] Int. Cl.[5] ..... C10M 129/72; C10M 133/16

[52] U.S. Cl. ..... 252/51.5 R; 252/51.5 A; 44/343; 548/255; 548/260; 548/261

[58] Field of Search ..... 252/51.5 R, 51.5 A; 44/343; 548/255, 260, 261

[56] References Cited

U.S. PATENT DOCUMENTS

| | | | |
|---|---|---|---|
| 3,413,227 | 11/1968 | Howard et al. | 252/51.5 R |
| 4,035,309 | 7/1977 | Brois | 252/49.7 |
| 4,096,077 | 6/1978 | Swakon | 252/51.5 R |
| 4,144,180 | 3/1979 | Andress, Jr. | 252/50 |
| 4,174,285 | 11/1979 | Braid | 252/51.5 R |
| 4,212,754 | 7/1980 | Chibnik | 252/49.7 |

*Primary Examiner*—Margaret Medley
*Attorney, Agent, or Firm*—Alexander J. McKillop; Malcolm D. Keen; Charles A. Malone

[57] ABSTRACT

Organic triazole-derived carboxylic acid-esters, and ester-amide-amine salts have been found to be effective antiwear additives for lubricants.

12 Claims, No Drawings

LUBRICANT COMPOSITIONS COMPRISING TRIAZOLE-DERIVED ACID-ESTERS OR ESTER-AMIDE-AMINE SALTS AS ANTIWEAR ADDITIVES

BACKGROUND OF THE INVENTION 1. Field of the Invention

This invention is directed to triazole-derived acid-esters or ester-amide salts as antiwear additives for hydrocarbyl lubricants and/or fuels. 2. Description of Related Art The use of triazole derivatives, such as benzotriazole, and 1,2,4-triazole, have been well known for their anticorrosion, metal passivating properties as well as biological properties in a variety of lubricant applications, as disclosed in U.S. Pat. Nos. 4,791,206 and 4,456,539, and fungicide/biocide applications.

The use of carboxylic acids, such as oleic acid, and the use of succinic anhydride derivatives, such as dodecenyl succinic anhydride-alcohol adduct, have been extensively reported as having beneficial antirust properties as well as detergency/dispersancy characteristics.

BRIEF SUMMARY OF THE INVENTION

It has now been found that lubricant compositions containing small additive concentrations of ester, acid, amide, or amine salts or triazole substituted carboxylic anhydrides possess excellent antiwear properties coupled with good extreme pressure/load carrying and anti-corrosion activities. Both the triazole moiety and the carboxylic acid-ester-amide-amine salt moiety are believed to provide the basis for the synergistic antiwear and significant antioxidant and metal passivation properties to these novel additives. It is also expected that the performance benefits will include antifatigue, antispalling, antistaining, antisquawking, improved additive solubility, improved load carrying/bearing, extreme pressure, improved thermal and oxidative stability, friction reducing, antiwear, anticorrosion, cleanliness improvingg, low- and high-temperature antioxidant, emulsyfying/demulsifying, detergency and antifoaming properties as well as improving fuel economy.

All of these beneficial properties are believed to be enhanced as a result of this novel internal synergism. This unique internal synergism concept is believed to be applicable to similar structures containing (a) triazole groups, and (b) ester-acid-amide-amine salt groups within the same molecule. The products of this patent application show good stability and compatibility when used in the presence of other commonly used additives in lubricant compositions.

This invention is, accordingly, more particularly directed to organic triazole-derived carboxylic acid-esters, and ester-amide salts which have been found to be effective antiwear additives for hydrocarbyl lubricants, to improved hydrocarbyl lubricants containing same and to a method of improving the lubricity of lubricant and grease formulations comprising adding minor amounts of the described additives to a major amount of said lubricant or grease formulations.

DESCRIPTION OF THE PREFERRED EMBODIMENTS

Triazoles (benzotriazole, tolyltriazole, or 1,2,4-triazole, etc.) were reacted with alkylene oxides, e.g., 1,2-epoxyhexadecane, etc., to form triazole-derived alcohols.

These alcohols were then reacted with carboxylic anhydrides (substituted succinic or phthalic anhydrides) to form dibasic acid esters, or diesters, as generally described below:

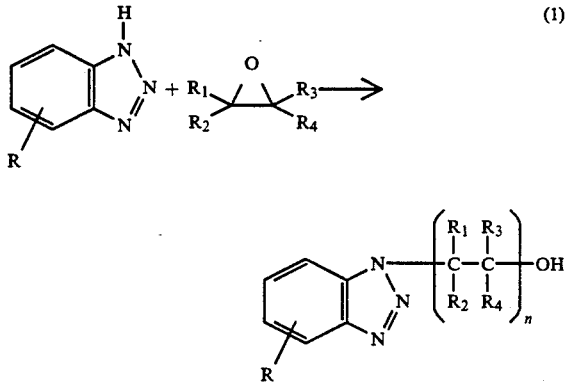

(1)

Where R is hydrogen or $C_1$ to $C_{24}$ hydrocarbyl or hydrocarbyloxy-hydrocarbylene or mixtures thereof; where $R_1$, $R_2$, $R_3$, $R_4$ are hydrogens or $C_1$ to $C_{30}$ hydrocarbyl, n=1 to 20.

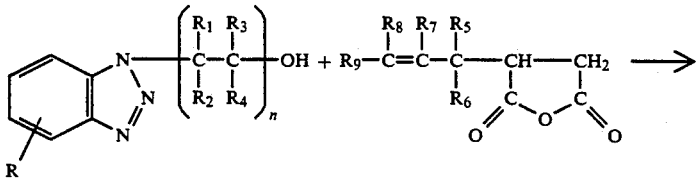

(2)

-continued

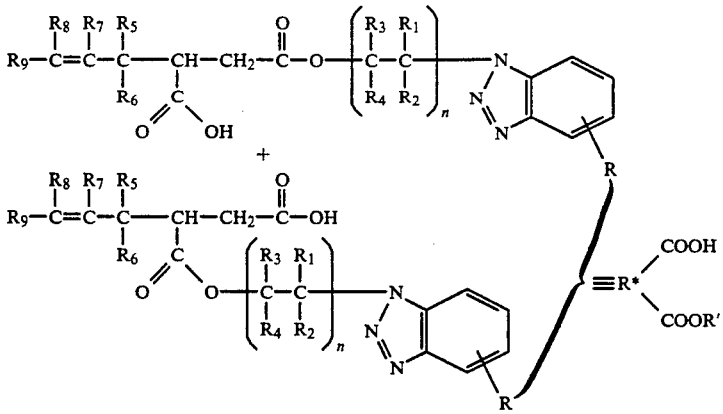

Where R* represents the hydrocarbyl moiety, such as alkenyl substituted succinic (dibasic) moiety, and R′ represents the triazole derived moiety.

These substituted succinic acid-ester derivatives were subsequently converted to their corresponding diester, amide-ester, amine salts by reaction with almost molar quantities, or less than molar quantities, or more than molar quantities of amines or hydroxy or hydroxyamine compounds to make neutral, acidic, or basic derivatives (Equation 3 below). Generally, amines used in this invention can be alkylamines (primary, secondary, tertiary, diamines, polyamines, polyoxyalkylene amines, ether aimes, etc.) or arylamines, hydroxy compounds used in the invention can be phenols, alcohols and hydroxyesters and hyroxyamines used can be monoethanolamine, diethanolamine, triethanolamine, dimethylethanolamine, trishydroxyethyl ethylene diamine, amonopropoyldiethanolamine, ethoxylated amines (such as ethoxylated cocoalkylamine), ethoxylated diamines and propoxylated amines.

1,2-epoxyhexadecane. A preferred carboxylic anhydride is an alkenyl succinic anhydride.

Suitable alkylene oxides include but are not limited to the following 1,2-epoxyhexandecane, 1,2-epoxybutane, 1,2-epoxypropane,ethylene oxide, 1,2-epoxyhexane, 1,2-epoxydecane, 1,2-epoxyoctane, 1,2-epoxydodecane, epoxidized soybean oil, epoxidized octyl soyate, epodized linseed oil and the like.

Suitable carboxylic anhydrides include but are not limited to the following: dodecenyl succinic anhydride, $C_{18}$–$C_{24}$ alkenyl succinic anhydride, butenyl succinic anhydride, octadecenyl succinic anhydride, polyisobutenyl succinic anhydride (920 MW), octenyl succinic anhydride, polypropenylsuccinic anhydride, poly(1-butyl)succinic anhydride and the like. Although anhydrides are preferred, the carboxylate generating species can be used.

Any reactive amine or hydroxy compound can be used in the conversion of the acid-ester derivatives to the corresponding ester, amide-ester or amine salt.

(3)

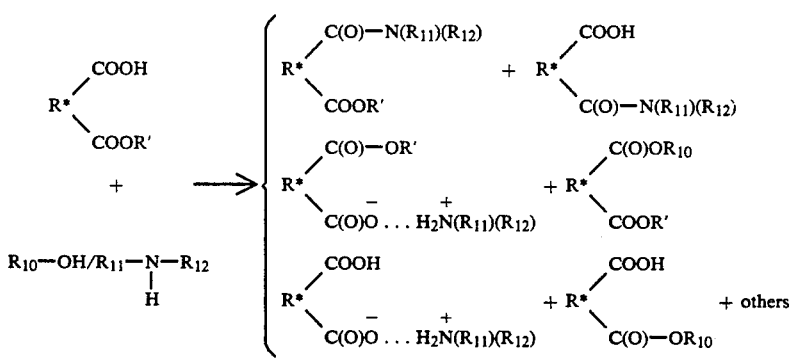

Where $R_5$–$R_8$ = hydrogen or hydrocarbyl groups or aralkyl groups or cycloalkyl groups or $C_1$–$C_{10}$ $R_9$ = hydrocarbon based groups of $C_1$–$C_{60}$ $R_{10}$ = hydrocarbon based group of $D_1$–$C_{60}$ or oxygen, nitrogen, sulfur, boroncontaining hydrocarbyl groups of $C_1$–$C_{60}$ $R_{11}$–$R_{12}$ hydrogen or hydrocarbyl groups of $C_1$–$C_{30}$′, or hydrocarboxy-hydrocarbylene groups R* and R′ are as defined above.

Any suitable triazole or alkylene oxide may be used in the invention preferred are such as tolyltriazole and Highly suitable reactive amines are disclosed in the list of amines or hydroxyaimines recited hereinabove. Other suitable hydroxy compounds include C1 to about C24 hydrocarbyl alcohols such as methanol, ethanol, etc. Hydroxybenzene, hydroxy acids such as glycolic acid, lactic acid, malic acid and the like.

Suitable triazoles include but are not limited to the following: benzotriazole, 1,2,4-triazole, tolyltriazole, dodecylbenzotriazole, carboxybenzotriazole and 4,5,6,7-benzotriazole and the like.

Generally speaking, conditions for the above described reactions may vary widely depending upon specific reactants, the presence or absence of a solvent and the like. Any suitable set of reaction conditions known to the art may be used. Generally, stoichiometric quantities of reactants are used. However, equimolar, more than molar or less than molar amounts may be used. An excess of up to 100% or more of any of the reactants can be used. Preferably the molar ratio of reactants varies from about 10:10:10:0 moles to about 1:1:10:10 moles respectively of triazole/alkylene oxide/anhydride/reactive compound. The reaction temperature may vary from ambient to about 250° C. or reflux, the pressure may vary from ambient or autogenous to about 500 psi.

The additives embodied herein are utilized in lubricating oil or grease compositions in an amount which imparts significant antiwear characteristics to the oil or grease as well as reducing the friction of engines operating with the oil in its crankcase. Concentrations of about 0,001 to about 10 wt. % based on the total weight of the composition can be used. Preferably, the concentration is from 0.1 to about 3 wt. %.

The additives have the ability to improve the above noted characteristics of various oleagenous materials such as hydrocarbyl lubricating media which may comprise liquid oils in the form of either a mineral oil or a synthetic oil, or in the form of a grease in which the aforementioned oils are employed as a vehicle.

In general, mineral oils, both paraffinic, naphthenic and mixtures thereof, employed as the lubricant, or grease vehicle, may be of any suitable lubricating viscosity range, as for example, from about 45 SSU at 100° F. to about 6000 SSU at 100° F. and preferably, from about 50 to about 250 SSU at 210° F. These oils may have viscosity indexes preferably ranging to about 95. The average molecular weights of these oils may range from about 250 to about 800. Where the lubricant is to be employed in the form of a grease, the lubricating oil is generally employed in an amount sufficient to balance the total grease composition, after accounting for the desired quantity of the thickening agent, and other additive components to be included in the grease formulation.

A wide variety of materials may be employed as thickening or gelling agents. These may include any of the conventional metal salts or soaps, which are dispersed in the lubricating vehicle in grease-forming quantities in an amount to impart to the resulting grease composition the desired consistency. Other thickening agents that may be employed in the grease formulation may comprise the non-soap thickeners, such as surface-modified clays and silicas, aryl ureas, calcium complexes and similar materials. In general, grease thickeners may be employed which do not melt and dissolve when used at the required temperature within a particular environment; however, in all other respects, any material which is normally employed for thickening or gelling hydrocarbon fluids for forming grease can be used in preparing grease in accordance with the present invention.

In instances where synthetic oils, or synthetic oils employed as the lubricant or vehicle for the grease, are desired in preference to mineral oils, or in combination therewith, various compounds of this type may be successfully utilized. Typical synthetic oils include, but are not limited to, polyisobutylene, polybutenes, hydrogenated polydecenes, polypropylene glycol, polyethylene glycol, trimethylpropane esters, neopentyl and pentaerythritol esters, di(2-ethylhexyl) sebacate, di(2-ethylhexyl) adipate, dibutyl phthalate, fluorocarbons, silicate esters, silanes, esters of phosphorus-containing acids, liquid ureas, ferrocene derivatives, hydrogenated synthetic oils, chain-type polyphenyls, siloxanes and silicones (polysiloxanes), alkyl-substituted diphenyl ethers typified by a butyl-substituted bis(p-phenoxy phenyl) ether, and phenoxy phenylethers.

It is to be understood, however, that the compositions contemplated herein can also contain other materials. For example, corrosion inhibitors, extreme pressure agents, low temperature properties modifiers and the like can be used as exemplified respectively by metallic phenates or sulfonates, polymeric succinimides, nonmetallic or metallic phosphorodithioates and the like. These materials do not detract from the value of the compositions of this invention, rather the materials serve to impart their customary properties to the particular compositions in which they are incorporated.

The additives in accordance with the invention are believed to be highly useful in fuel compositions, particularly in liquid hydrocarbon fuels or oxygenated fuels such as alcoholic fuels and the like and mixtures thereof. The present additives are used in fuel compositions in amounts ranging from about 1 to about 1000 pounds of additive per 1000 barrels of fuel and preferably from about 10 to about 250 pounds per 1000 pounds of fuel. In addition to liquid hydrocarbon and oxygenated combustion fuels, distillate fuels and fuel oils are also contemplated.

The following examples are merely illustrative and are not meant to be limitations.

EXAMPLE 1

Reaction Product of Tolyltriazole, 1,2-Epoxyhexadecane, Dodecenyl Succinic Anhydride, and Alkylamine 40.0 gm (0.3 mol) of tolyltriazole was charged into a 1 liter reactor equipped with dropping funnel, reflux condensor, thermometer, and mechanical stirrer.

Approximately 100 ml toluene was added into the reactor to make a suspension.

Approximately 72 gm (0.3 mol) of 1,2-epoxyhexadecane (commercially obtained from Viking Chemical Company (ATOCHEM) under the trade name Vikolox 16) was cautiously added dropwise to the suspension at 60°-65° C. over a course of one hour. The moderate reaction exotherm brought the reaction temperature up to about 90° C. At the end of the addition, 79.8 gm (0.3 mol) of dodecenyl succinic anhydride was added at temperature below 70° C. A nitrogen sparger inlet was used to replace the dropping funnel in the four-neck reactor. This mixture was heated at 100° C. for two hours and at 100° C. for another two hours, and at the end of the reaction, it was cooled down to ambient temperature as a yellow, viscous liquid.

Approximately 57.3 gm (0.3 mol) of $C_{11}$-$C_{14}$ alkylamine (commercially obtained from Rohm-Haas Chemical Company under the tradename Primene 81R) was added to the above liquid. This reaction mixture was heated up to 110° C. for two hours, and was further refluxed for a few hours and then the volatiles were stripped under house vacuum (approximately 250 to 300 mmHg) leaving a viscous material as the desired product.

EXAMPLE 2

Reaction Product of Tolyltriazole, 1,2-Epoxyhexadecane, and Dodecenyl Succinic Anhydride The reaction is similar to Example 1, but with the omission of the Primene 81R hydrocarbylamine step.

EXAMPLE 3

Reaction Product of Tolyltriazole, 1,2-Epoxyhexadecane, and $C_8$–$C_{24}$ Alkenyl Succinic Anhydride The reaction procedure of Example 2 was followed with one exception: equimolar alkenyl succinic anhydride, derived from mixed $C_{18}$–$C_{24}$ olefins, was used instead of dodecenyl succinic anhydride.

EVALUATION OF PRODUCTS

The product of the above Examples was blended into fully formulated mineral oils and evaluated for antiwear performance using the Four-Ball test (ASTM Method D-2266, Table 1).

TABLE 1

| Four-Ball Wear Test (40 Kg, 1800 rpm, 30 min., 200° F.) | |
|---|---|
| Item | Wear Scar Diameter (mm) |
| Base Oil (80% solvent refined paraffinic bright, 20% solvent refined paraffinic neutral oil) | 0.733 |
| 1% Example 1 in above base oil | 0.553 |
| 1% Example 2 in above base oil | 0.567 |
| 1% Example 3 in above base oil | 0.539 |

The product of the above Examples was also blended into fully formulated engine oils and evaluated for load-carrying performance using the Four-Ball EP Test (Tables 2 and 3).

The Four-Ball EP Test (ASTM D-2783) measures the extreme pressure characteristics of a lubricant by a Load Wear Index (LWI) and a weld point. A test ball is rotated under load at a tetrahedral position on top of three stationary balls immersed in lubricant. Measurements of scars on the three stationary balls are used to calculate load wear index (LWI), and the weld is the load at which the four balls weld together in 10 seconds. The higher the LWI value the better. For further details of the Four-Ball EP Test (ASTM D-2783), see U.S. Pat. No. 4,965,002.

TABLE 2

| Four-Ball EP Test (1760 rpm, 10 sec., 25° C.) | | | |
|---|---|---|---|
| Item | Last Non-Seizure Load (Kg) | Weld Load (Kg) | Load Wear Index (LWI) |
| Base oil (700 sus fully formulated solvent refined paraffinic neutral oil containing antioxidant/antiwear/anti-corrosion/detergent performance package) | 100 | 250 | 44.1 |
| Base oil plus 0.25% extra sulfurized olefin (Anglamol 33, commercially obtained from Lubrizol Corp.) | 100 | 250 | 46.8 |
| Base oil plus .5% Example 1 | 200 | 250 | 77.1 |
| Base oil plus .5% Example 2 | 160 | 200 | 61.5 |
| Base oil plus .5% Example 3 | 126 | 200 | 50.9 |

TABLE 3

| Four-Ball EP Test (1760 rpm, 10 sec., 75° C.) | | | |
|---|---|---|---|
| Item | Last Non-Seizure Load (Kg) | Weld Load (Kg) | Load Wear Index (LWI) |
| Base oil (700 sus fully formulated solvent refined paraffinic neutral oil containing antioxidant/antiwear/anti-corrosion/detergent performance package) | 100 | 250 | 44.1 |
| Base oil plus 0.25% extra sulfurized olefin (Anglamol 33, commercially obtained from Lubrizol Corp.) | 100 | 250 | 49.1 |
| Base oil plus .5% Example 1 | 126 | 250 | 52.6 |

As shown above, the products of this invention demonstrate considerable EP activity as evidenced by the improvement of the load wear index and the micro-seizure load.

Although these products have demonstrated significant antiwear/EP activity, they are extremely non-corrosive to metals, such as copper alloys, as evidenced by the copper strip corrosivity performance (Table 4).

The Copper Strip Corrosivity Test (ASTM D-130) measures a product's propensity to corrode copper due to, for example, contained sulfur groups.

TABLE 4

| Copper Strip Corrosivity (250° F., 3 hours) | |
|---|---|
| Item | Corrosivity Rating |
| Base oil (700 sus fully formulated solvent refined paraffinic neutral oil containing antioxidant/antiwear/anti-corrosion/detergent performance package) | 1a |
| 0.5% Example 1 in above base oil | 1b |
| 0.5% Example 2 in above base oil | 1b |
| 0.5% Example 3 in above base oil | 1a |

The use of additive concentrations of triazole-substituted carboxylic acid-ester-amide-amine salt derivatives in premium quality industrial and automotive lubricants will significantly enhance the stability, improve load-carrying, reduce the wear, and extend the service life. These additives also have potential to be used in gasoline and diesel fuels as antiwear additives, and corrosion inhibitors. These novel compositions described in this patent information are useful at low concentrations and do not contain any potentially undesirable metals or sulfur, phosphorus.

Although the present invention has been described with preferred embodiments, it is to be understood that modifications and variations may be resorted to, without departing from the spirit and scope of this invention, as those skilled in the art will readily understand. Such variations and modifications are considered within the purview and scope of the appended claims.

What is claimed is:

1. An improved lubricant composition comprising a major proportion of an oil of lubricating viscosity or grease prepared therefrom and a minor multifunctional antiwear, load-carrying/EP, and copper corrosion inhibiting proportion of an additive product of reaction prepared by reacting (1) a triazole or hydrocarbyl substituted triazole with a hydrocarbyl oxide to form a triazole-derived alcohol and thereafter (2) reacting said triazole-derived alcohol with a hydrocarbyl carboxylic anhydride or its acid equivalent selected from succinic or phthalic anhydrides or hydrocarbyl substituted succinic or phthalic anhydrides or their acid equivalents to produce substituted hydrocarbyl carboxylic acidester derivativies and (3) converting said acid-ester derivatives to their corresponding diester, amide-ester salts by reaction with amine, hydroxy or hydroxyamine compounds and wherein the reactions are carried out at temperatures varying from ambient to about 250° C. under ambient or autogenous pressures, in molar ratios of reactants varying from equimolar to more than molar to less than molar for times sufficient to obtain the desired additive product of reaction.

2. The composition of claim 1 wherein reaction (2) is carried out as follows:

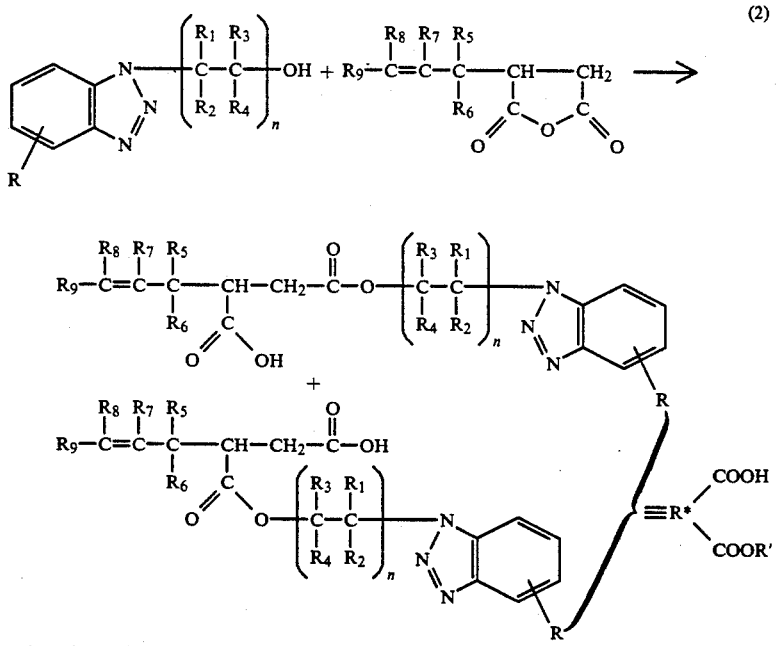

(2)

wherein R is hydrogen or $C_1$–$C_{24}$ hydrocarbyl or hydrocarbyloxyhydrocarbylene or mixture thereof; where $R_1$, $R_2$, $R_3$, $R_4$ are hydrogens or $C_1$–$C_{30}$ hydrocarbyl, R5–R8 are hydrogen or $C_1$–$C_{10}$ hydrocarbyl groups or alkyl groups of $C_1$–$C_{10}$ or cycloalkyl groups of $C_3$–$C_{10}$, $R_9$ is a $C_1$–$C_{60}$ hydrocarbon based group, n=1 to 20 and where R* represents the hydrocarbyl acid moiety and R' represents the triazole derived moiety, and where the hydrocarbyl acid groups are selected from the group consisting of alkyl, alkenyl, aryl, alkaryl, aralkyl which may be cyclic or polycyclic and optionally contain substituted with O, N, S or mixtures thereof.

3. The composition of claim 1 wherein the reactants are dodecenylsuccinic anhydride, tolyltriazole, 1, 2-epoxyhexadecane and $C_{11}$–$C_{14}$ alkylamine.

4. The composition of claim 1 wherein the reactants of Step 1 are dodecenylsuccinic anhydride and tolyltriazole, and said reaction product is reacted in step 2with 1,2-epoxyhexadecane.

5. The composition of claim 1 wherein the reactants of Step 1 are $C_{18}$–$C_{24}$ alkenyl succinic anhydride and tolyltriazole and said reaction product is reacted in step 2 with 1,2-epoxyhexadecane.

6. The composition of claim 1 wherein the lubricant is an oil of lubricating viscosity selected from the group consisting of (1) mineral oils, (2) synthetic oils, or (3) mixtures of mineral and synthetic oils or (4) is a grease prepared from any one of (1), (2) or (3).

7. The composition of claim 6 wherein the lubricant contains from about 0,001 to about 10 wt% based on the total weight of the composition of the additive product of reaction.

8. The composition of claim 6 wherein the lubricant is a mineral oil.

9. A process of preparing a multifunctional antiwear, corrosion inhibiting, rust inhibiting and thermal color stabilizing additive product prepared by reacting (1) a triazole or hydrocarbyl substituted triazole with a hydrocarbyl oxide to form a triazole-derived alcohol and thereafter (2) reacting said triazole-derived alcohol with a hydrocarbyl carboxylic anhydride or its acid equivalent selected from succinic or phthalic anhydrides or hydrocarbyl substituted succinic or phthalic anhydrides or their acid equivalents to produce substituted hydrocarbyl carboxylic acid-ester derivatives and (3) converting said acid-ester derivatives to their corresponding diester, amide-ester salts by reaction with amine or hydroxy compounds and wherein the reactions are carried out at temperatures varying from ambient to about 250° C. under ambient or autogenous pressures, in molar ratios of reactants varying from equimolar to more than molar to less than molar for times sufficient to obtain the desired additive product of reaction.

10. The process of claim 9 wherein the reaction is carried out as follows:

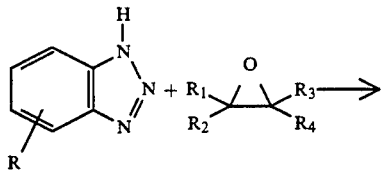

(1)

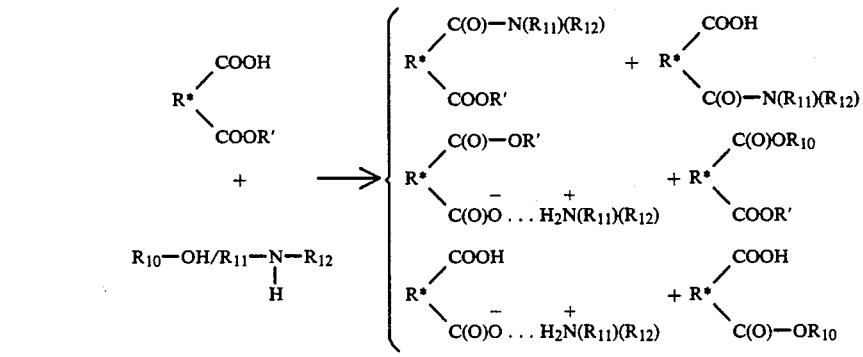

(3)

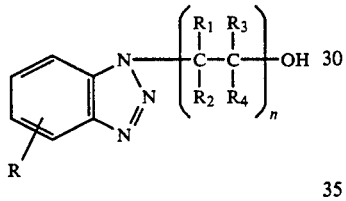

Where R is hydrogen or $C_1$–$C_{24}$ hydrocarbyl or hydrocarbyloxyhydrocarbylene or mixture thereof; where $R_1$, $R_2$, $R_3$, $R_4$ are hydrogens or $C_1$–$C_{30}$ hydrocarbyl, n=1 to 20,

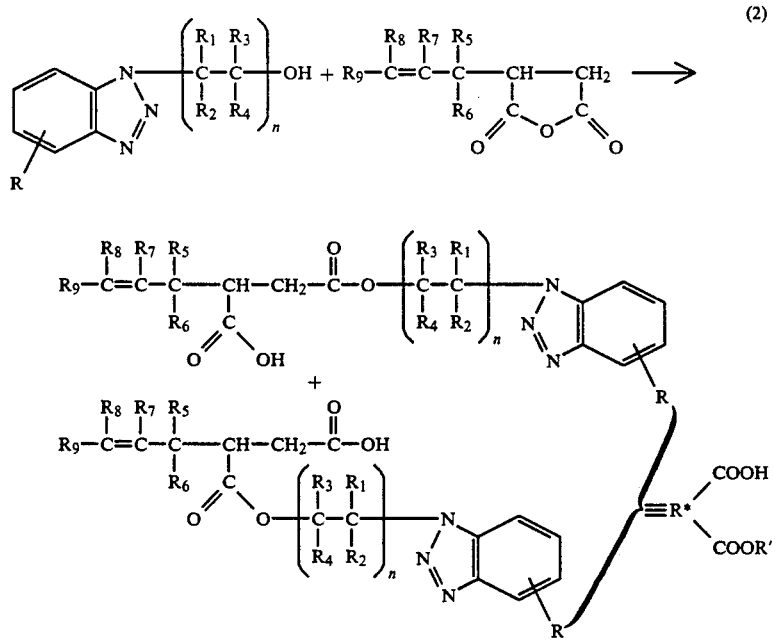

(2)

Wherein R* represents the hydrocarbyl acid moiety and R′ represents the triazole derived moiety, R5–R8 are hydrogen or $C_1$–$C_{10}$ hydrocarbyl groups or aralkyl group of $C_1$–$C_{10}$ or cycloalkyl group of $C_1$–$C_{10}$ $R_9$ is a $C_1$–$C_{60}$ hydrocarbon based groups; and where the hydrocarbyl groups are selected from the group consisting of alkyl, alkenyl, aryl, alkaryl, aralkyl which may be cyclic or polycyclic and optionally substituted with O, N, S or mixtures thereof.

Where $R_{10}$ is a $C_1$–$C_{60}$ hydrocarbon based group or a $C_1$–$C_{60}$ hydrocarbyl containing O, N, S or B and R11–R12 are H or C1–C30 hydrocarbyl or hydrocarbylene.

11. A multifunctional antiwear, copper corrosion inhibiting, and load-carrying/EP additive product of reaction prepared by reacting (1) a triazole or selected from succinic or phthalic anhydrides or hydrocarbyl substituted succinic or phthalic anhydrides or their acid equivalents substituted triazole with a hydrocarbyl oxide to form a triazole-derived alcohol and thereafter (2)reacting said triazole-derived alcohol with a hydrocarbyl carboxylic anhydride or its acid equivalent to product substituted hydrocarbyl carboxylic acid-ester derivatives and (3) converting said acid-ester derivatives to their corresponding diester, amide-ester salts by reaction with amine or hydroxy or hydroxyamine compounds wherein the reactions are carried out at temperatures varying from ambient to about 250° C. under ambient or autogenous pressures, in molar ratios of reactants varying from equimolar to more than molar to less than molar for times sufficient to obtain the desired additive product of reaction.

12. A method of preparing an improved lubricant composition comprising adding to said lubricant a minor multifunctional antiwear, copper corrosion inhibiting, load-carrying/EP proportion of from about 0.001 to about 10 wt% based on the total weight of the composition of an additive product of reaction as claimed in claim 11.

* * * * *

UNITED STATES PATENT AND TRADEMARK OFFICE

CERTIFICATE OF CORRECTION

PATENT NO. : 5,328,625

DATED : July 12, 1994

INVENTOR(S) : L.O. Farng, et al

It is certified that error appears in the above-indentified patent and that said Letters Patent is hereby corrected as shown below:

Col. 11, line 36, Claim 10, delete "Where" and insert --wherein--.

Col. 12, line 2, Claim 10, after "aralkyl group of" delete "$C_1$-$C_{10}$" and insert --$C_7$-$C_{10}$--.

Col. 12, line 2, Claim 10, after "cycloalkyl group of" delete "$C_1$-$C_{10}$ and insert --$C_3$-$C_{10}$--.

Col. 12, line 24, Claim 10, delete "Where" and insert --wherein--.

Col. 12, line 30, Claim 11, after "triazole or" insert --hydrocarbyl--.

UNITED STATES PATENT AND TRADEMARK OFFICE

CERTIFICATE OF CORRECTION

PATENT NO. : 5,328,625

DATED : July 12, 1994

INVENTOR(S) : L.O. Farng, et al

It is certified that error appears in the above-indentified patent and that said Letters Patent is hereby corrected as shown below:

Col. 12, lines 31 & 32, Claim 11, after "triazole or" delete "selected from succinic or phthalic anhydride or hydrocarbyl substituted succinic or phthalic anhydride or their acid equivalents" and insert paragraph at line 37 after "equivalent".

Col. 12, line 37, Claim 11, after "~~equivalent~~" delete "product " and insert --produce--.

Signed and Sealed this

Eighth Day of November, 1994

Bruce Lehman

*Attest:*

BRUCE LEHMAN

*Attesting Officer*

*Commissioner of Patents and Trademarks*